US009816520B2

(12) United States Patent
Hayes-Pankhurst et al.

(10) Patent No.: US 9,816,520 B2
(45) Date of Patent: Nov. 14, 2017

(54) PUMP FITTINGS AND METHODS FOR THEIR MANUFACTURE

(71) Applicant: QUANTEX PATENTS LIMITED, London (GB)

(72) Inventors: Richard Paul Hayes-Pankhurst, London (GB); Jonathan Edward Ford, London (GB)

(73) Assignee: QUANTEX PATENTS LIMITED, London (GB)

( * ) Notice: Subject to any disclaimer, the term of this patent is extended or adjusted under 35 U.S.C. 154(b) by 498 days.

(21) Appl. No.: 14/350,281

(22) PCT Filed: Oct. 4, 2012

(86) PCT No.: PCT/EP2012/069643
§ 371 (c)(1),
(2) Date: Apr. 7, 2014

(87) PCT Pub. No.: WO2013/050488
PCT Pub. Date: Apr. 11, 2013

(65) Prior Publication Data

US 2014/0255164 A1 Sep. 11, 2014

(30) Foreign Application Priority Data

Oct. 7, 2011 (GB) ..... 1117297.0

(51) Int. Cl.
*F04D 29/18* (2006.01)
*F04C 5/00* (2006.01)
(Continued)

(52) U.S. Cl.
CPC ..... *F04D 29/18* (2013.01); *B67D 1/10* (2013.01); *F04C 5/00* (2013.01); *F04C 27/003* (2013.01); *Y10T 29/49236* (2015.01)

(58) Field of Classification Search
CPC . B67D 1/10; F04C 27/003; F04C 5/00; Y10T 29/49236
See application file for complete search history.

(56) References Cited

U.S. PATENT DOCUMENTS 2,933,046 A * 4/1960 McCray ..... F04C 5/00 418/154
3,240,533 A * 3/1966 Mommsen ..... B05B 7/144 239/325
(Continued)

FOREIGN PATENT DOCUMENTS

DE 103 11 655 7/2004
GB WO 2010122299 A2 * 10/2010 ..... F04C 5/00
WO WO 2013/050491 4/2013

OTHER PUBLICATIONS

International Search Report for PCT/EP2012/069643 dated Jul. 17, 2013.
(Continued)

*Primary Examiner* — Mary A Davis
(74) *Attorney, Agent, or Firm* — B. Aaron Schulman, Esq.; Stites & Harbison, PLLC

(57) ABSTRACT

A pump fitting has an inlet adaptor (10) for connection to an outlet (39) of a container (38) of fluid and including an inlet passage (10), an outlet passage (11) for fluid and a pump housing (12) between the inlet passage (10) and the outlet passage (11). The pump housing (12) contains a rotor (17) rotatably received in an interior surface of the housing (12). The rotor (17) includes a housing-engaging surface (23, 24) co-operating with the interior surface of the housing (12) to form a seal therebetween and also including at least one shaped surface (21, 22) radially inwardly of the housing-engaging surface and forming with the interior surface of the housing a chamber (25, 26) for conveying fluid from the inlet passage (10) to the outlet passage (11) on rotation of the
(Continued)

rotor (17). A seal (28) is provided between the outlet passage (10) and the inlet passage (11), the seal (28) being urged into engagement with the rotor (17) to prevent fluid passing from the outlet passage (11) to the inlet passage (10) as the shaped surface rotates. The inlet passage (10), the outlet passage (11) and the housing (12) are formed as a one-piece molding.

22 Claims, 6 Drawing Sheets

(51) Int. Cl.
*B67D 1/10* (2006.01)
*F04C 27/00* (2006.01)

(56) References Cited

U.S. PATENT DOCUMENTS

| | | | | |
|---|---|---|---|---|
| 3,459,337 | A * | 8/1969 | Williamson | A61M 5/142 418/152 |
| 3,771,901 | A | 11/1973 | Svensson | |
| 5,006,049 | A * | 4/1991 | von der Heyde | F04C 5/00 417/476 |
| 7,674,100 | B2 | 3/2010 | Hayes-Pankhurst et al. | |
| 2011/0121020 | A1* | 5/2011 | Springer | B67D 1/07 222/1 |
| 2012/0034122 | A1 | 2/2012 | Hayes-Pankhurst et al. | |

OTHER PUBLICATIONS

Written Opinion of the International Searching Authority for PCT/EP2012/069643 dated Jul. 17, 2013.

* cited by examiner

PUMP FITTINGS AND METHODS FOR THEIR MANUFACTURE

The invention relates to pump fittings and methods for their manufacture.

It is known to dispense liquids from a container using a pump or tap. Where, for example, the liquid is wine, the container may include a manually operated tap for this purpose. Such taps are not capable of dispensing accurate quantities nor is the flow rate consistent although they are cheap and can be disposed of with the container. Alternatively, the container is connected to a dispenser that includes a peristaltic or diaphragm or other rotary pump that draws liquid from the container for delivery. These are capable of delivering more accurate quantities of liquid but are expensive to provide and require frequent cleaning for hygiene purposes and periodic maintenance.

According to a first aspect of the invention, there is provided, a pump fitting for a container of fluid comprising an inlet adaptor for connection to an outlet of a container of fluid and including an inlet passage, an outlet passage for fluid and a pump housing between the inlet passage and the outlet passage, the pump housing containing a rotor rotatably received in an interior surface of the housing, the rotor including a housing-engaging surface co-operating with the interior surface of the housing to form a seal therebetween and also including at least one shaped surface radially inwardly of the housing-engaging surface and forming with the interior surface of the housing a chamber for conveying fluid from the inlet to the outlet on rotation of the rotor, a seal being provided between the outlet passage and the inlet passage, the seal being urged into engagement with the rotor to prevent fluid passing from the outlet passage to the inlet passage as the shaped surface rotates, the inlet passage, the outlet passage, the seal and the housing being formed as a one-piece moulding.

Such a pump fitting is easy and cheap to produce, can deliver accurate quantities of liquid and may be disposed of with the container.

According to a second aspect of the invention, there is provided a liquid delivery system comprising a pump fitting according to the first aspect of the invention and a container of liquid connected to the inlet passage of the pump fitting.

According to a third aspect of the invention, there is provided a method of manufacturing a pump fitting according to the first aspect of the invention and in which the seal is a flexible diaphragm located in a aperture in the housing and comprising the step of forming the inlet passage, the outlet passage, and the housing as a single moulding and then moulding the diaphragm in situ in one-piece with the inlet passage, the outlet passage and the housing.

The following is a more detailed description of some embodiments of the invention, by way of example, reference being made to the accompanying drawings in which.

Figure 1:
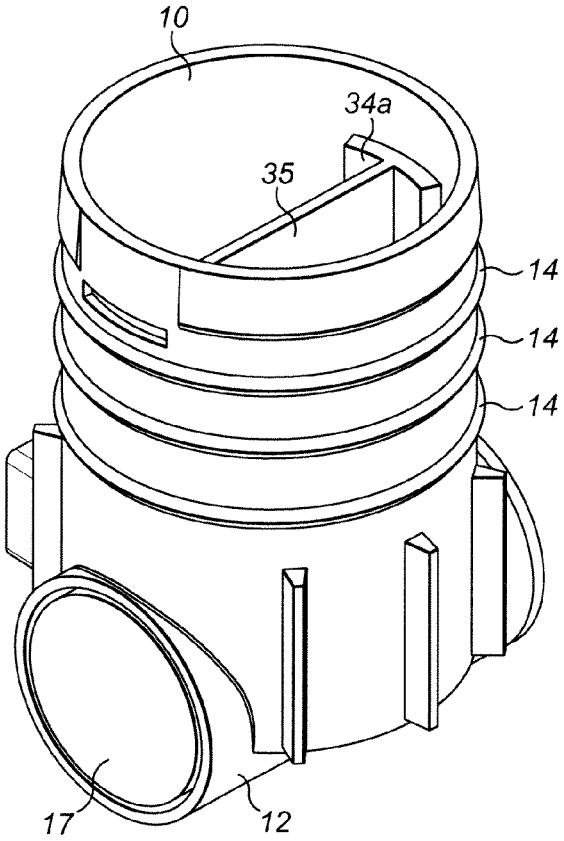
FIG. 1 is a perspective view of a pump fitting for a container of fluid.
Figure 2:
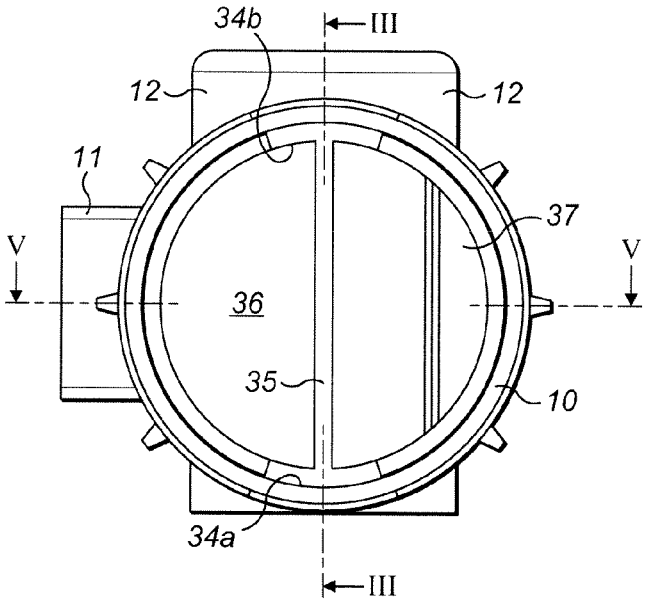
FIG. 2 is a plan view from above of the pump fitting of FIG. 1.
Figure 3:
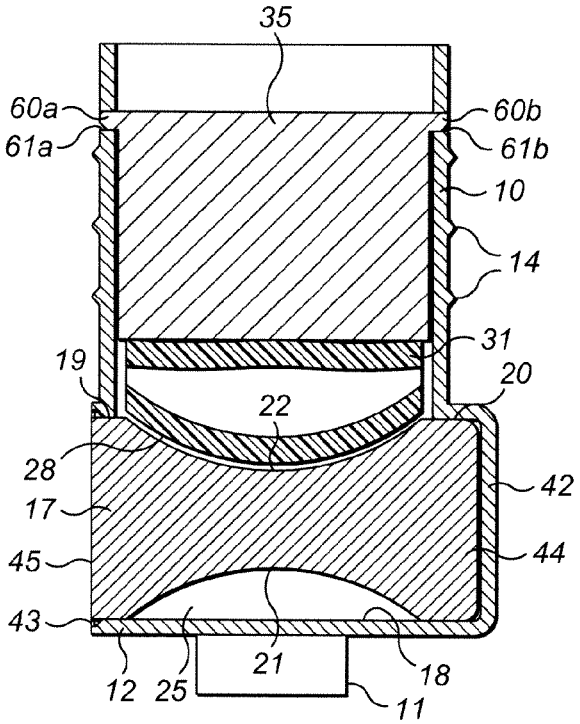
FIG. 3 is a section on the line III-III of FIG. 2 with a rotor of the pump fitting in a first position.
Figure 4:
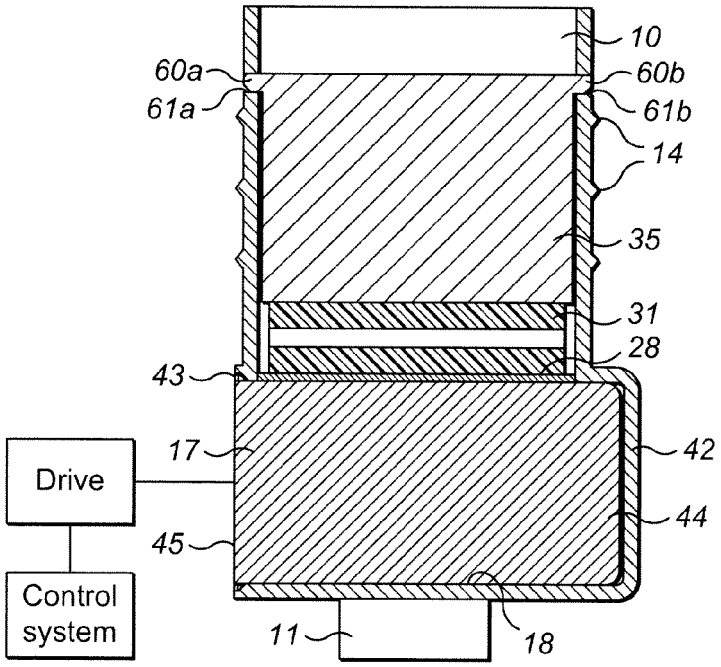
FIG. 4 is a similar view to FIG. 3 but with the rotor in a second position.
Figure 5:
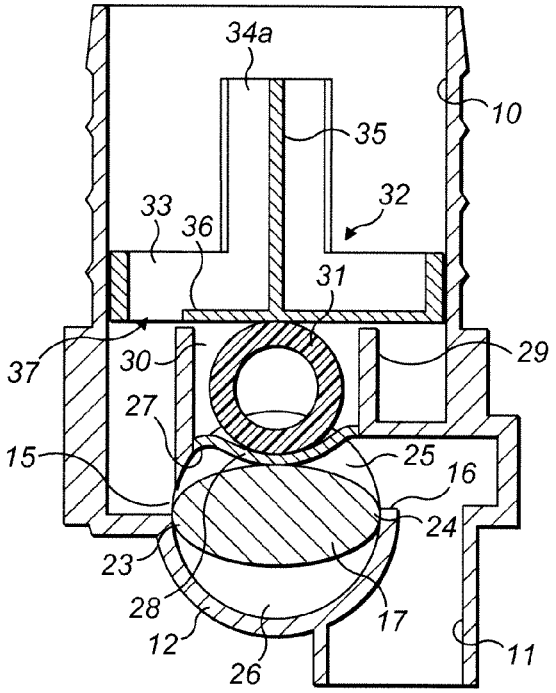
FIG. 5 is a section on the line V-V of FIG. 2 with the rotor in the first position of FIG. 3.
Figure 6:
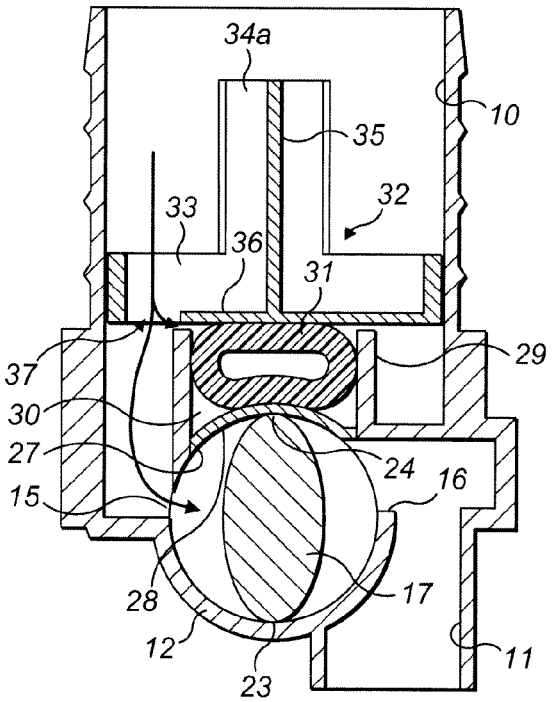
FIG. 6 is a similar view to FIG. 5 but with the rotor in the second position of FIG. 4.
Figure 7:
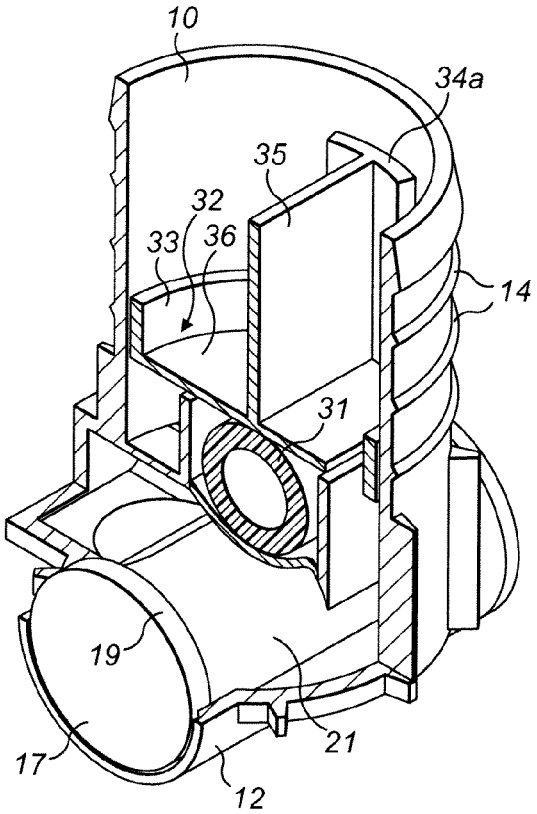
FIG. 7 is a similar view to FIG. 1 but with the pump fitting partly broken away and with the rotor in the first position of FIGS. 3 and 5.
Figure 8:
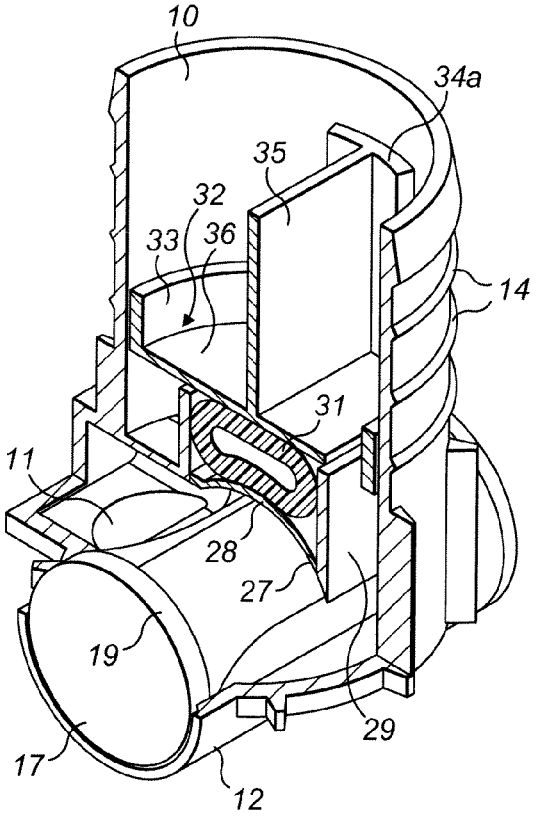
FIG. 8 is a similar view of FIG. 7 but with the rotor in the second position of FIGS. 4 and 6.
Figure 9:
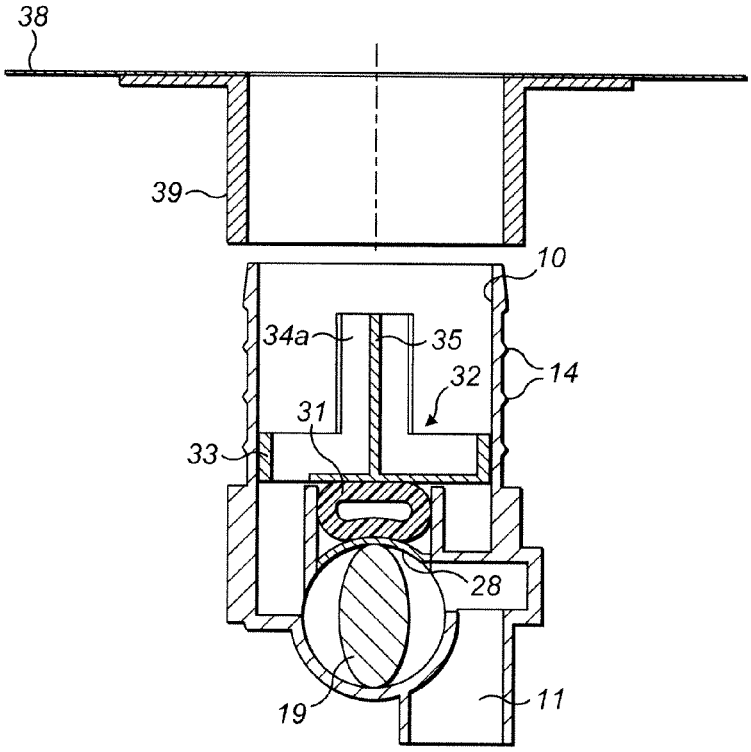
Figure 10:
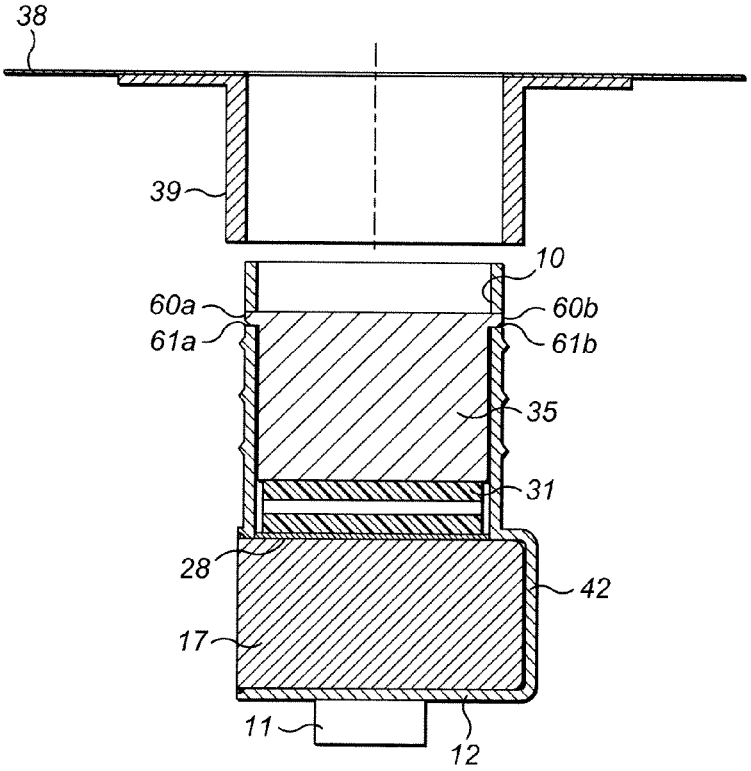
Figure 11:
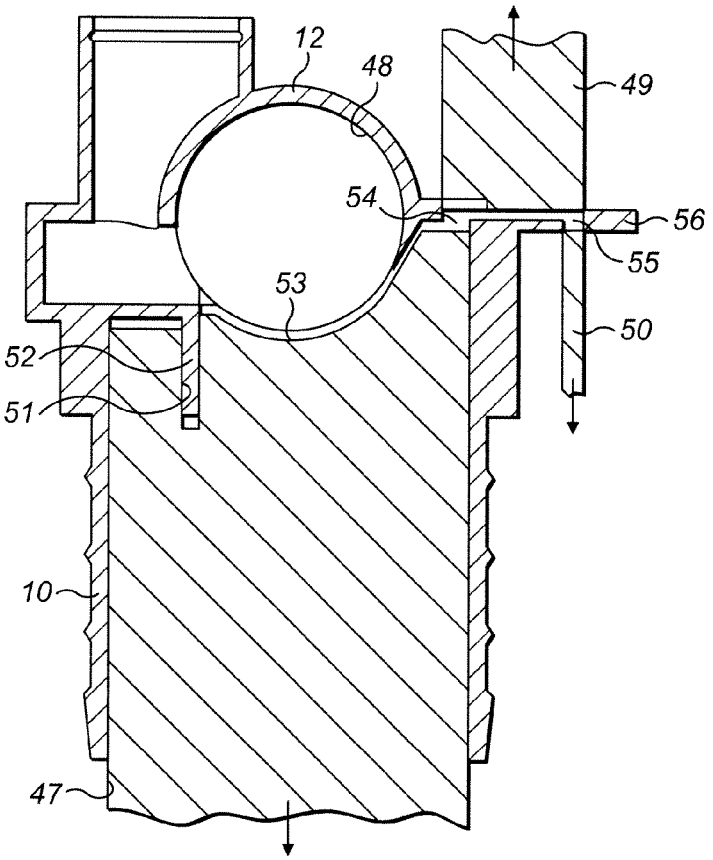
Figure 12:
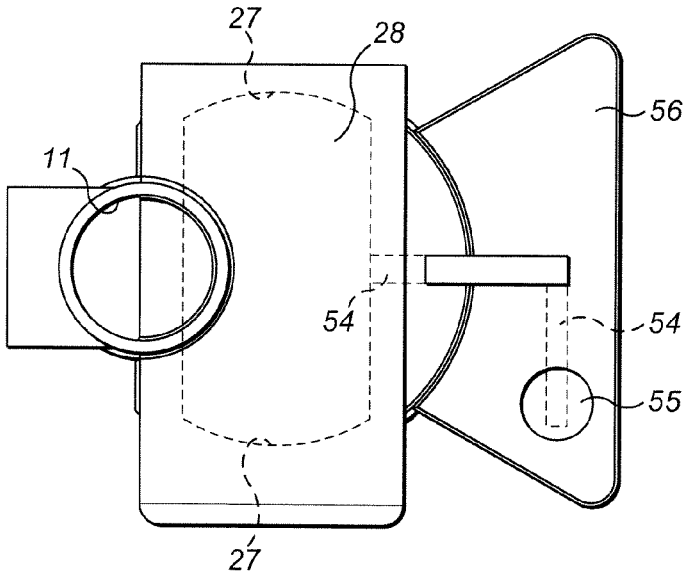

FIG. 9 is a similar view to FIG. 6 but showing the pump fitting positioned to connect to a container of liquid, FIG. 10 is a similar view to FIG. 4 but showing the pump fitting positioned to connect to a container of fluid, FIG. 11 is a schematic cross-sectional view of part of a mould tool to be used in a moulding machine for moulding the pump fitting of FIGS. 1 to 10, and showing a one-piece moulding and first, second third and fourth cores moved to form a mould for a diaphragm seal of the fitting, and FIG. 12 is an underneath plan view of the mould tool of FIG. 11.

Referring first to FIGS. 1 to 6, the pump fitting comprises an inlet passage 10, an outlet passage 11 and a pump housing 12 between the inlet passage 10 and the outlet passage 11. The inlet passage 10, the outlet passage 11 and the pump housing 12 may be formed in one piece by a single moulding process from any suitable material. This will be described in more detail below.

As seen in FIGS. 1 to 6, the inlet passage 10 is generally cylindrical with an outer surface formed with a plurality of axially spaced circumferentially extending ribs 14. The pump housing 12 is generally cylindrical and of smaller diameter than the diameter of the inlet passage 10. The pump housing 12 is carried at a lower end of the inlet passage 10 with its axis normal to the axis of the inlet passage 10. This is best seen in FIGS. 3, 4, 5 and 6. The pump housing 12 is provided with an inlet opening 15 (see FIGS. 5 and 6) that provides fluid communication between the inlet passage 10 and the interior of the pump housing 12. The outlet opening 16 (see FIGS. 5 and 6) provides a fluid connection between the interior of the pump housing 12 and the outlet passage 11. In addition, as seen in FIGS. 3 and 4, the housing 12 has a closed end 42 and an open end 43.

The outlet passage 11 is generally cylindrical and has an axis that is parallel to the axis of the inlet passage 10. As seen in FIGS. 5 and 6, the axis of the outlet passage 11 is spaced from the axis of the inlet passage 10.

A rotor 17 is rotatably received in an interior surface 18 of the pump housing 12. As seen in FIGS. 3 and 4, the rotor 17 has first and second generally cylindrical ends 19, 20. These ends 19, 20 are a close fit with the interior surface 18 (see FIGS. 3 and 4) of the pump housing 12 to support the rotor 17 for rotation and to prevent the leakage of fluid between the rotor 17 and the interior surface 18. An end face 44 at the second end 20 of the rotor 17 bears against the closed end 42 of the housing 12 to provide a thrust bearing wall for the rotor 17. An end face 45 at the first end 19 of the rotor is exposed for connecting the rotor 17 to a drive, as described below.

The rotor 17 is formed with two shaped surfaces 21, 22. As seen in FIGS. 5 and 6, the surfaces 21, 22 are shaped so that the rotor is generally elliptical in cross section at the centre of the rotor 17 (see FIGS. 5 and 6) but substantially circular in cross section adjacent the cylindrical ends 19, 20.

The rotor 17 is formed with first and second housing engaging surfaces 23, 24 (see FIGS. 5 and 6) that extend between the shaped surfaces 21, 22 and seal against the interior surface 18 of a pump housing 12 to prevent the passage of fluid around the rotor 17.

The first and second shaped surfaces 21, 22 form with the interior surface 18 of the pump housing 12 respective first and second chambers 25, 26. The function of these chambers 25, 26 will be described below in connection with the operation of the pump fitting.

The pump housing 12 is formed, between the outlet opening 16 and the inlet opening 15, with an aperture closed by a flexible diaphragm seal 28. The aperture 27 is surrounded by a wall 29 extending away from the rotor 17 in a direction normal to the axis of the pump housing 12 and projecting into the inlet passage 10. The wall 29 forms a chamber 30 containing a flexible hollow tube 31. As seen in FIG. 3, the tube 31, in its substantially uncompressed state, has a minimum diameter at its first and second ends and a maximum diameter intermediate the ends. The tube 31 is pressed into contact with the diaphragm 28 which in turn is pressed into contact with the rotor 17 by a cap 32.

As seen in FIGS. 5, 6, 7 and 8, the cap 32 includes an annular outer wall 33 that is a sliding fit within the inlet passage 10. Two diametrically opposed part-cylindrical guide surfaces 34*a*, 34*b* project upwardly from the outer wall 33 and are also in sliding engagement with the interior surface of the inlet passage 10. A central rib 35 extends between the guide surfaces 34*a*, 34*b*. The lower end of the outer wall 33 is closed by a disc 36. As seen in FIGS. 5 and 6, this disc 36 bears against the tube 31 to force the tube 31 into contact with a diaphragm seal 28. As seen in FIG. 10, the free ends of the guide surfaces 34*a*, 34*b* include respective lugs that engage in holes in the inlet passage 10 to locate the cap 32 relative to the inlet passage 10. On assembly, the circular inlet passage 10 is momentarily distorted into an oval to allow the lugs on the cap 32 to pass into the passage 10.

The disc 36 is provided with an aperture 37 to allow the flow of fluid along the inlet passage 10 to the rotor 17.

The pump fitting described above with reference to the drawings is for connection to a container of liquid 38, part of which is shown schematically in FIGS. 9 and 10. The container 38 may hold any suitable liquid to be pumped such as, for example, wine. The term "liquid" is to be taken, however, to encompass liquids such as soups and paints.

The container 38 includes an outlet passage 39 that is cylindrical in shape and which is a mating fit with the inlet passage 10 of the pump fitting. The inlet passage 10 is inserted into the outlet passage 39, with the ribs 14 securing the parts together and providing a seal. This engagement prevents the tube 10 distorting and so the lugs cannot disengage from the tube 10 so ensuring that the cap 32 is locked to the tube 10.

The exposed end face 45 of the rotor 17 is connected to a drive, which may be in the form of an electric motor. The drive itself may be controlled by a control system. The motor rotates the rotor 17 in an anti-clockwise direction as seen in FIGS. 5 and 6. Starting from the position shown in FIG. 5, rotation of the rotor 17 rotates the first chamber 25 around the housing 12 to communicate the first chamber 25 with the outlet passage 11. At the same time. the second chamber 26 communicates with the inlet passage 10 to receive liquid from the container 38. Further rotation of the rotor 17 conveys the liquid in the second chamber 2 around to the outlet passage 11 at the same time squeezing the liquid from the first chamber 25 through the outlet passage 11.

During this rotation, the diaphragm seal 28 and the tube 31 work together to prevent the passage of liquid from the outlet passage 11 to the inlet passage 10. As seen in FIGS. 3, 4, 5 and 6, the tube 31 urges the diaphragm seal 28 into contact with the surface of the rotor 17 throughout the rotation of the rotor 17 contacting alternately the housing engaging surfaces 23, 24 of the rotor and the shape surfaces 21, 22 of the rotor. As seen in FIGS. 3 and 4, the shape of the tube ensures that an even pressure is applied to the diaphragm seal 28 along its axial extent.

As will be seen in FIGS. 5 and 6, the diaphragm seal 28 and the tube 31 are located at an end of the inlet passage 11. This saves space so making the pump fitting compact. In addition, and as also seen in FIGS. 5 and 6, the chamber 30 receives liquid from the inlet passage 10 and the pressure of this liquid is applied to the under surface of the diaphragm seal 28. This increases the force urging the diaphragm seal 28 against the rotor 17. If the pressure of fluid in the container 38 is increased, by, for example, the container 38 being crushed, the pressure urging the diaphragm seal 28 against the rotor 17 will be increased, so reducing or preventing the leakage of liquid past the rotor as a result of the pressure increase.

The control system can be used to control the drive so that the rotor delivers a predetermined volume of liquid at a predetermined flow rate through the outlet passage 11.

The arrangement of the pump housing 12 and the rotor 17 need not be as described above. It could be of any of the types described in PCT/GB2005/003300 and PCT/GB2010/000798.

It will be appreciated that the pump fitting provides a simple and inexpensive way of delivering liquid from the container 38. The inlet passage 10 and the outlet passage 11 provide a direct path out of the container 38 interrupted only by the rotor and diaphragm. The pump fitting has few moving parts and so is reliable in operation. In addition, the pump fitting is capable of delivering a measured quantity of liquid with great accuracy so making it suitable for delivering measured quantities of potable liquids such as wine and concentrated liquids. Since the pump fitting is inexpensive to manufacture, it may be provided as a part of the container 38 and disposed of with the container 38 when the container 38 is empty. The rigid outlet passage 39 may be part of a container 38 that is collapsible. It is desirable to evacuate as much of such a container as possible. It is difficult to evacuate any liquid left in this rigid part so incorporating as much of the pump into this volume as possible reduces the dead volume and so improves the utilisation of liquid.

As mentioned above, the inlet passage 10, the outlet passage 11, the diaphragm seal 28 and the pump housing 12 are formed as a one piece moulding in the same moulding process as follows and referring to FIGS. 11 and 12.

With reference to FIGS. 11 and 12, the moulding process for moulding in one-piece the inlet passage 10, the outlet passage 11 and the pump housing 12 utilises a mould tool with first, second, third and fourth cores 47, 48, 49 and 50. The first core 47 defines the interior of the inlet passage 10 and co-operates with the second core 48 to define the aperture 27 in the pump housing 12. In addition, the first core 47 defines a slot 51 that forms the one-piece moulding with a wall 52 adjacent an edge of the aperture 27. The third core 49 defines a sprue 56 extending from the pump housing 12 and the fourth core 50 engages the third core 49 to form a feed point 55.

Once this part of the moulding has been formed, the first core 47 is retracted as seen in FIG. 11 to space it from the second core 48 by the required thickness of the diaphragm seal 28 to form a mould chamber 53. The third core 49 and fourth core 50 are also retracted to form a passage 54 leading from the feed point 55 to the mould chamber 53 forming a diaphragm seal mould cavity. A molten material suitable to form the diaphragm seal 27 is injected through the feed point 55, through the passage 54 and into the mould chamber 53 to form the diaphragm seal 28 in one-piece with the remaining components.

In this way, whole of the pump fitting can be manufactured as a one-piece moulding using the same cavity in the tool using a twin screw moulding machine for each of the housing and diaphragm materials. This reduces size of the tool and reduces the time for production thereby reducing the cost of the pump fitting.

The invention claimed is:

1. A pump fitting for a container of fluid, the pump fitting comprising:

an inlet adaptor for connection to an outlet of a container of fluid, the inlet adaptor including an inlet passage;

an outlet passage for fluid;

a seal provided between the outlet passage and the inlet passage; and a pump housing disposed between the inlet passage and the outlet passage, the pump housing containing a rotor rotatably received in an interior surface of the housing, the rotor including a housing-engaging surface cooperating with the interior surface of the housing to form a seal therebetween and also including at least one shaped surface radially inwardly of the housing-engaging surface and forming with the interior surface of the housing a chamber for conveying fluid from the inlet passage to the outlet passage on rotation of the rotor, and wherein the seal is urged into engagement with the rotor to prevent fluid passing from the outlet passage to the inlet passage as the at least one shaped surface rotates, wherein the inlet passage, the outlet passage, the seal, and the housing are formed as a one-piece moulding, wherein the housing is substantially cylindrical, wherein the at least one shaped surface of the rotor is formed between opposing first and second ends of the rotor that are each substantially cylindrical, and wherein a diameter of the housing is less than a diameter of the inlet adaptor.

2. The pump fitting according to claim 1, wherein the inlet passage is substantially cylindrical about an axis of the inlet passage, and wherein the axis of the inlet passage is normal to an axis of rotation of the rotor.

3. The pump fitting according to claim 2, wherein the outlet passage is substantially cylindrical about an axis of the outlet passage, and wherein the axis of the outlet passage is parallel to the axis of the inlet passage.

4. The pump fitting according to claim 3, wherein the axis of the outlet passage is offset from the axis of the inlet passage.

5. The pump fitting according to claim 1, wherein the inlet passage terminates in an inlet opening in the housing, and wherein an outlet opening in the housing leads to the outlet passage.

6. The pump fitting according to claim 5, wherein the outlet passage is substantially cylindrical about an axis of the outlet passage, wherein the axis of the outlet passage is parallel to an axis of the inlet passage, and wherein the inlet and outlet openings are normal to the axis of the inlet passage.

7. The pump fitting according to claim 1, wherein the one-piece moulding forms a chamber provided by a surrounding wall extending in a direction normal to an axis of the housing, wherein a first end of the wall is closed by the seal and a second end of the wall that is opposite the first end is closed by a cap, and wherein at least one tube is provided within said chamber and acts between the cap and the seal to urge the seal towards the rotor.

8. The pump fitting according to claim 7, wherein the surrounding wall projects into the inlet passage, wherein the cap includes a disc-shaped member that is a sliding fit in the inlet passage, and wherein a face of the disc engaging provides said cap.

9. The pump fitting according to claim 8, wherein the disc-shaped member includes an aperture to allow passage of fluid along the inlet passage.

10. The pump fitting according to claim 1, wherein the housing is closed at a first end of the housing by an end wall providing a thrust bearing for the first end of the rotor, and wherein a second end of the housing that is opposite the first end of the housing is open to expose the second end of the rotor for connection to a drive for rotating the rotor to pump fluid from the inlet passage to the outlet passage.

11. A liquid delivery system comprising a pump fitting according to claim 1 and a container of liquid connected to the inlet passage of the pump fitting.

12. The liquid delivery system according to claim 11, wherein the container includes an outlet, the inlet passage of the pump fitting being a push-fit connection with said outlet.

13. The liquid delivery system according to claim 12, and further including a drive connected to the rotor to rotate the rotor and pump liquid from the container to the pump fitting outlet passage.

14. The liquid delivery system according to claim 11, further including a control system for controlling the drive to deliver a predetermined volume of liquid at a predetermined flow rate from the container to the pump fitting outlet passage.

15. A method of manufacturing a pump fitting according to claim 1 and in which the seal is a flexible diaphragm located in a aperture in the housing and comprising forming the inlet passage, the outlet passage, and the housing as a single moulding, and then moulding the seal in situ in one-piece with the inlet passage, the outlet passage, and the housing.

16. The method of manufacturing a pump fitting according to claim 15, wherein forming the one-piece moulding includes locating first and second mould parts to form said aperture in the housing, adjusting the relative positions of the first and second mould parts to form a mould cavity, and then injecting into said cavity material that forms the seal in one-piece with the housing.

17. The method of manufacturing a pump fitting according to claim 16, wherein the first mould part defines the inlet passage, and wherein the first mould part is moved relative to the second mould part to form the mould cavity.

18. The method of manufacturing a pump fitting according to claim 17, wherein the one-piece moulding includes a passage for injection of diaphragm material into the mould cavity.

19. The method of manufacturing a pump fitting according to claim 16, wherein the first mould part is a core located in and guided by the inlet passage of the one-piece moulding when moving to form the mould cavity.

20. The pump fitting according to claim 1, wherein, in use, liquid from the inlet passage is applied to the seal to urge the seal against the rotor.

21. A pump fitting for a container of fluid, the pump fitting comprising:

an inlet adaptor for connection to an outlet of a container of fluid, the inlet adaptor including an inlet passage;

an outlet passage for fluid;

a seal provided between the outlet passage and the inlet passage; and a pump housing disposed between the inlet passage and the outlet passage, the pump housing containing a rotor rotatably received in an interior surface of the housing, the rotor including a housing-engaging surface cooperating with the interior surface of the housing to form a seal therebetween and also including at least one shaped surface radially inwardly of the housing-engaging surface and forming with the interior surface of the housing a chamber for conveying fluid from the inlet passage to the outlet passage on rotation of the rotor, and wherein a flexible member is arranged at an end of the inlet passage to urge the seal into engagement with the rotor to prevent fluid passing from the outlet passage to the inlet passage as the at least one shaped surface rotates, wherein the housing is substantially cylindrical, wherein the at least one shaped surface of the rotor is formed between opposing ends of the rotor that are each substantially cylindrical, and wherein a diameter of the housing is less than a diameter of the inlet adaptor.

22. The pump fitting according to claim 21, wherein, in use, liquid from the inlet passage is applied to the seal to urge the seal against the rotor.

* * * * *